US005733843A

United States Patent [19]

Minami et al.

[11] Patent Number: 5,733,843

[45] Date of Patent: Mar. 31, 1998

[54] THERMAL SENSITIVE RECORDING SHEET

[75] Inventors: Toshiaki Minami; Tomoaki Nagai; Kaoru Hamada; Akio Sekine, all of Tokyo, Japan

[73] Assignee: Nippon Paper Industries Co., Ltd., Tokyo, Japan

[21] Appl. No.: 637,901

[22] Filed: Apr. 26, 1996

[30] Foreign Application Priority Data

Apr. 26, 1995 [JP] Japan ..... 7-102113

[51] Int. Cl.[6] ..... B41M 5/30

[52] U.S. Cl. ..... 503/209; 427/150; 503/216; 503/225

[58] Field of Search ..... 503/208, 209, 503/216, 217, 225; 427/150, 151

[56] References Cited

U.S. PATENT DOCUMENTS

| | | | |
|---|---|---|---|
| 4,973,571 | 11/1990 | Koike et al. | 503/227 |

FOREIGN PATENT DOCUMENTS

| | | | |
|---|---|---|---|
| 0358193 | 3/1990 | European Pat. Off. | 503/209 |
| 0585127 | 3/1994 | European Pat. Off. | 503/216 |
| 43-4160 | 2/1968 | Japan | 503/221 |
| 45-14039 | 7/1970 | Japan | 503/221 |
| 49-109120 | 10/1974 | Japan | 503/221 |
| 59-106456 | 6/1984 | Japan | 503/216 |
| 59-116262 | 7/1984 | Japan | 503/216 |
| 59-190891 | 10/1984 | Japan | 503/221 |
| 60-13852 | 1/1985 | Japan | 503/216 |
| 5-4449 | 1/1993 | Japan | 503/216 |
| 7304727 | 11/1995 | Japan | 503/216 |
| 825810 | 1/1996 | Japan | 503/216 |
| 853407 | 2/1996 | Japan | 503/216 |
| 858242 | 3/1996 | Japan | 503/216 |

*Primary Examiner*—Bruce H. Hess

*Attorney, Agent, or Firm*—Sherman and Shalloway

[57] ABSTRACT

Discloses a thermal sensitive recording sheet which has features of high sensitivity, excellent heat resistance, excellent water proof and excellent durability to oil. The thermal sensitive color developing layer is mainly composed of a basic achromatic dye including the compound indicated by general formula (I) or (II), an organic color developer and a stabilizer indicated by general formula (III). And the said layer is arranged on a substrate and forms the thermal sensitive recording sheet.

(I)

(II)

(III)

2 Claims, No Drawings

THERMAL SENSITIVE RECORDING SHEET

BACKGROUND OF THE INVENTION

1. [Field of the Invention]

This invention relates to a thermal sensitive recording sheet which has features of high sensitivity, excellent heat resistance, water proof and durability to oil.

2. [Description of the Prior Art]

Generally, thermal sensitive recording sheets are produced by following method. A colorless or a pale colored basic achromatic dye and an organic developer made from a phenolic compound or the like are independently ground into fine particles and dispersed, then the resulting dispersion are mixed together. A binder, a filler, a sensitizer, a lubricant and other auxiliaries are added to the resulting mixture to prepare a coating color. The coating color is coated on a substrate such as paper, synthetic paper, film or plastic. Color development recording is effected by instantaneous chemical reaction caused by heating with a thermal pen, a thermal sensitive head, a hot stamp or laser light or the like.

Generally these thermal sensitive recording sheets are widely applied to measuring recorders, terminal printers of computors, facsimiles, automatic ticket bending machines and bar cord labels and the like. Recently these office machines are improved to have multiple functions and to perform a higher quality and along with these progress the required quality for a thermal sensitive recording sheet become higher. For example, along with the progress of high speed recording, the performance of high recording density and clear color image by minute thermal energy, is required to the recording sheet. Meanwhile, the thermal recording sheets are required to have excellent qualities such as resistance against light, weather and oil.

As the prior art of the thermal recording sheet, for example the thermal recording mediums are disclosed in Japanese patent publication S43-4160 and Japanese patent publication S45-14039. However, since these thermal recording mediums have defects. For instance, in the case of high speed recording, since the response speed to thermal energy is slow, sufficient color developing density can not be obtained.

As the method to improve above mentioned defects, high sensitive leuco dyes such as 3-N-methyl-N-cyclohexilamino-6-methyl-7-anilinofuluoran (Japanese Laid-open publication S49-109120) and 3-dibuthylamino-6-methyl-7-anilinofuluoran (Japanese Laid-open publication S59-190891) are developed. And the techniques to improve a thermal sensitive sheet so as to have a quick response time and high sensitivity are disclosed by using the substances having exellent color developing ability such as 1,7-bis(4-hydroxyphenylthio)-3,5-dioxaheptane (Japanese Laid-open publication S59-106456), 1,5-bis(4-hydroxyphenylthio)-3-oxahepthane (Japanese Laid-open publication S59-116262) and 4-hydroxy-4'-isopropoxy diphenylsulfone (Japanese patent publication S63-46067) as a color developer.

The use of dimerizated thiourea composition as third additives with the color devoloping component comprising a dye precursor and salicylate acid is disclosed in Japanese Laid-open publication H5-4449. In which, the use of thiourea is explained to give a good result on stabilizing of an image.

However, although these thermal sensitive recording sheets desclosed in above mentioned documents have high sensitivity, have a defect of low heat resistance. That is, after storaged in high temperature for long time, the density of color image falls down.

Further, these thermal sensitive recording sheet have poor data for storage ability. By the contact with water or fatty component from skin, or by the contact with plasticizer (DOP, DOA or the like) included in wrapping film of polyvinylchloride and the like, the density of color image extremely falls down or fades out.

SUMMARY OF THE INVENTION

The object of this invention is to provide a thermal sensitive recording sheet which has features of high sensitivity and excellent resistance against heat, water and oil with using specific sulfonic phenol compound as an organic color developer, and with using specific aminobenzenesulfonamide derivative as a stabilizer.

The inventors have conduced intensive study to develop a new thermal sensitive recording sheet, and consequently, found out that the above mentioned problems can be solved by using a thermal sensitive color developing layer in which specific sulfonic phenol compound indicated by general formula (I) or (II) is included as an organic color developer, and also specific aminobenzenesulfonamido derivatives indicated by general formula (III) is included as a stabilizer by the amount of 0.08–0.8 parts wherein the amount of an organic color developer is fixed to 1 parts.

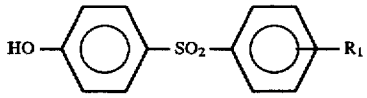

(I)

("$R_1$" indicates hydroxy group, n-propoxy group, isopropoxy group or n-butoxy group)

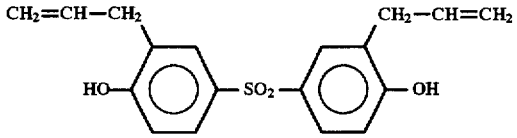

(II)

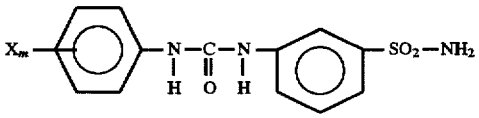

(III)

("X" indicates lower alkyl group of carbon number 1–4, alkoxy group of carbon number 1–3, hydrogen atom, nitro group, cyano group, or halogen atom. "m" indicates an integral number from 1 to 3)

The examples of derivatives of aminobenzenesulfonamide which are used as stabilizers in present invention are indicated by using chemical formula and compound number as follows, but is not limited to them. And, the following derivatives of aminobenzenesulfonamide can be used alone or in combination with two or more as occasion demands.

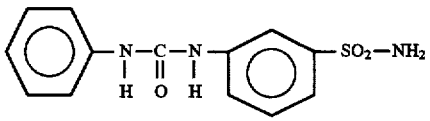

(A-1)

-continued
(A-2)
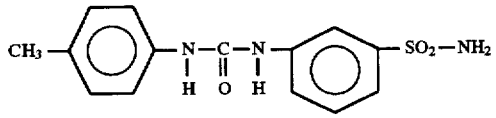
(A-3)
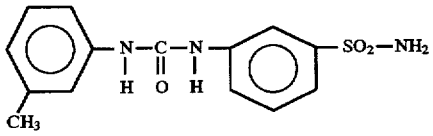
(A-4)
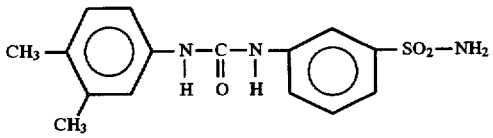
(A-5)
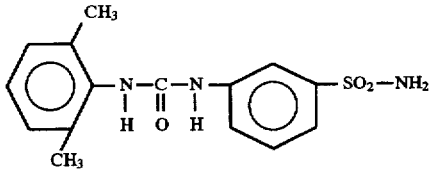
(A-6)
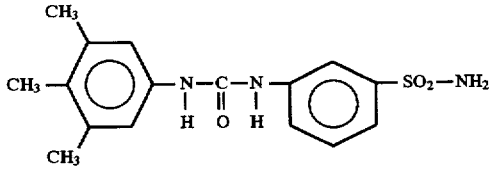
(A-7)
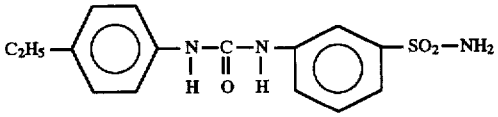
(A-8)
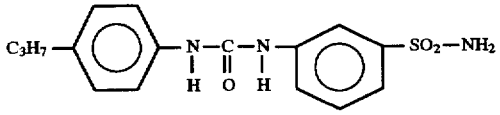
(A-9)
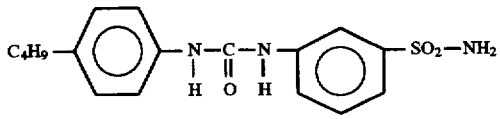
(A-10)
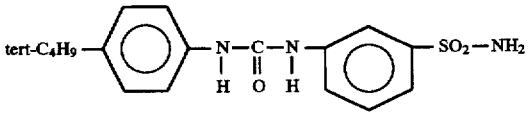
(A-11)
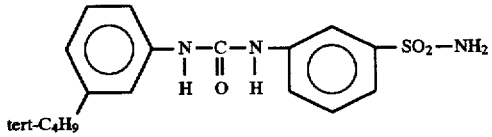
(A-12)
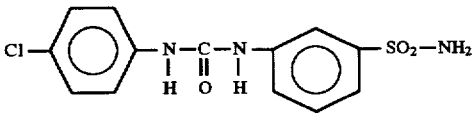
-continued
(A-13)
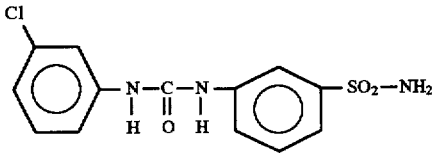
(A-14)
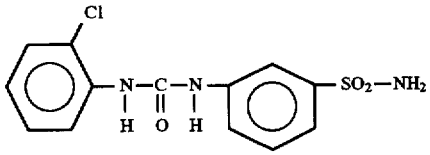
(A-15)
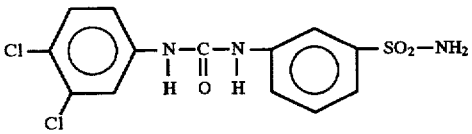
(A-16)
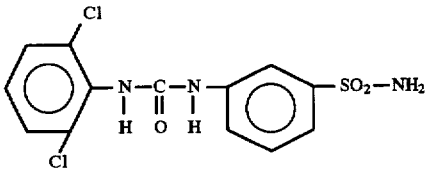
(A-17)
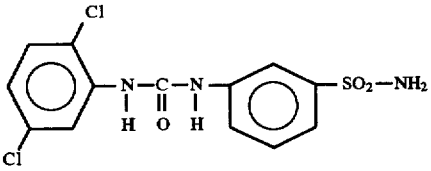
(A-18)
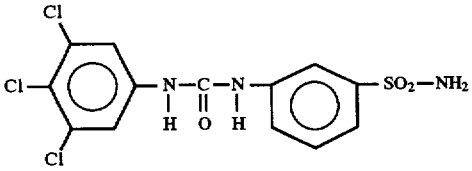
(A-19)
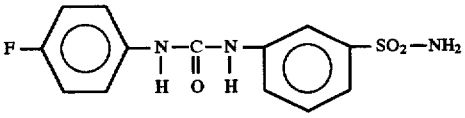
(A-20)
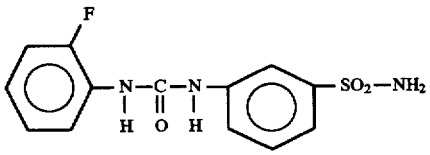
(A-21)
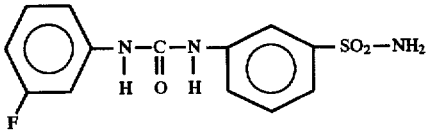
(A-22)
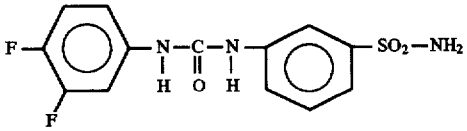

-continued
(A-23)
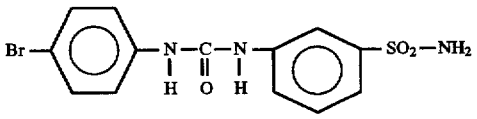
(A-24)
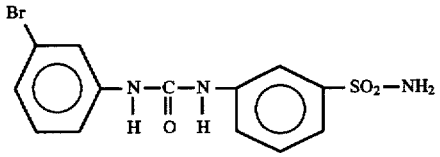
(A-25)
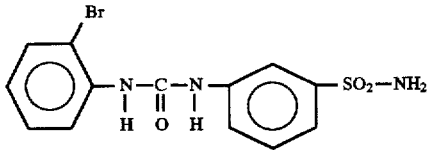
(A-26)
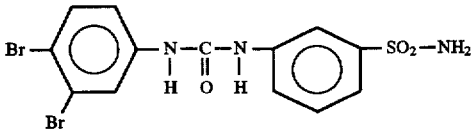
(A-27)
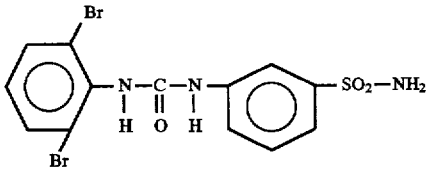
(A-28)
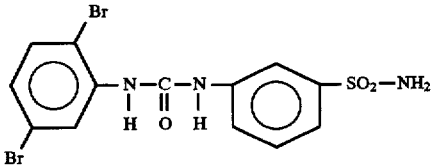
(A-29)
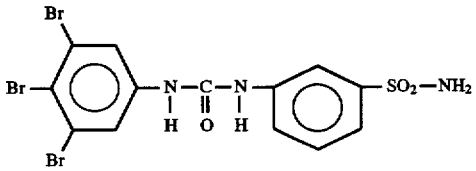
(A-30)
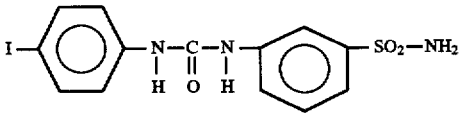
(A-31)
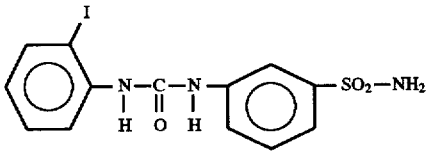
(A-32)
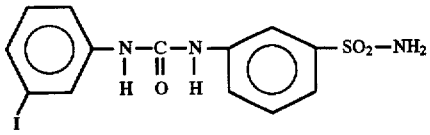
-continued
(A-33)
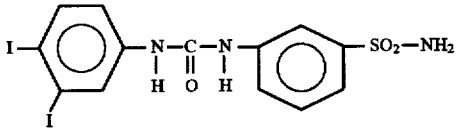
(A-34)
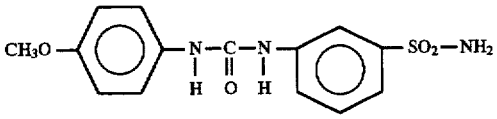
(A-35)
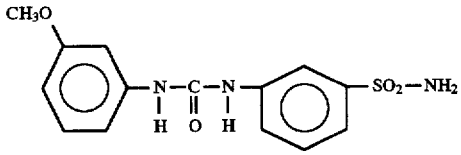
(A-36)
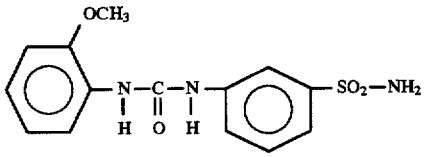
(A-37)
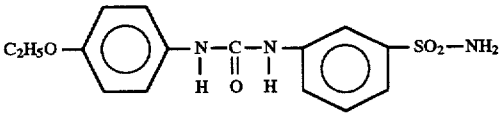
(A-38)
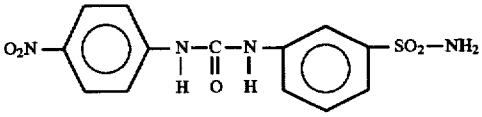
(A-39)
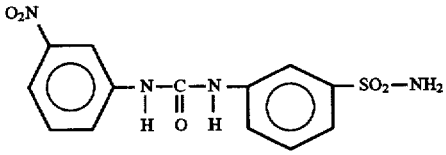
(A-40)
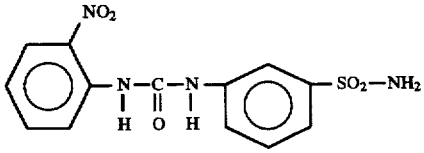
(A-41)
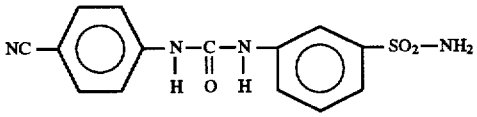
(A-42)
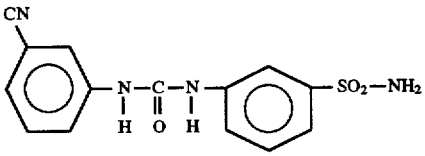
(A-43)
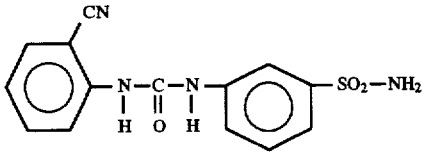

Following compounds can be used as the organic color developer in present invention.

4-hydroxy-4'-isopropoxydiphenylsulfone
4-hydroxy-4'-n-propoxydiphenylsulfone
4-hydroxy-4'-n-butoxydiphenylsulfone
2,4'-dihydroxydiphenylsulfone
bis-(3-alyl-4-hydroxyphenyl)sulfone As the basic achromatic dye used in this invention, chemical compounds such as triphenylmethane, fluoran, fluorene and divinyl-based dyes are desirable to be used and specific examples of these basic achromatic dyes are shown below, but are not limited to them. These dyes can be used alone or in combination with two or more.

<Triphenylmethane-Based Leuco Dyes>

3,3-bis(p-dimethylaminophenyl)-6-dimethylaminophthalide [another name is crystal violet lactone]

<Fluoran-Based Leuco Dyes (I)>

3-diethylamino-6-methyl-7-anilinofluoran
3-(N-ethyl-p-toluidino)-6-methyl-7-anilinofluoran
3-(N-ethyl-N-isoamylamino)-6-methyl-7-anilinofluoran
3-diethylamino-6-methyl-7-(o, p-dimethylanilino)fluoran
3-pyrrolidino-6-methyl-7-anilinofluoran
3-pyperidino-6-methyl-7-anilinofluoran
3-(N-cyclohexyl-N-methylamino)-6-methyl-7-anilinofluoran
3-diethylamino-7-(m-trifluoromethylanilino)fluoran
3-N-n-dibutylamino-6-methyl-7-anilinofluoran
3-N-n-dibutylamino-7-(o-chloroanilino)fluoran
3-(N-ethyl-N-tetrahydrofurfuryamino)-6-methyl-7-anilino fluoran
3-dibutylamino-6-chloro-7-anilinofluoran
3-dibutylamino-7-(o-chloroanilino)fluoran
3-diethylamino-7-(o-chloroanilino)fluoran
3-diethylamino-6-methyl-chlorofluoran
3-diethylamino-6-methyl-fluoran
3-cyclohexylamino-6-chlorofluoran
3-diethylamino-benzo[a]-fluoran
3-n-dipentylamino-6-methyl-7-anilinofluoran
2-(4-oxo-hexyl)-3-dimethylamino-6-methyl-7-anilinofluoran
2-(4-oxo-hexyl)-3-diethylamino-6-methyl-7-anilinofluoran
2-(4-oxo-hexyl)-3-dipropylamino-6-methyl-7-anilinofluoran <Fluorene-Based Leuco Dyes>

3, 6, 6'-tris(dimethylamino)spiro[fluorene-9,3'-phthalide]
3, 6, 6'-tris(diethylamino)spiro[fluorene-9,3'-phthalide]

<Fluoran-Based Leuco Dyes (II)>

2-methyl-6-p-(p-dimethylaminophenyl)aminoanilinofluoran
2-methoxy-6-p-(p-dimethylaminophenyl) aminoanilinofluoran
2-chloro-3-methyl-6-p-(p-phenylaminophenyl)-aminoanilino fluoran
2-chloro-6-(p-dimethylaminophenyl)aminoanilinofluoran
2-nitro-6-(p-diethylaminophenyl)aminoanilinofluoran
2-amino-6-(p-diethylaminophenyl)aminoanilinofluoran
2-diethylamino-6-p-(p-diethylaminophenyl) aminoanilinofluoran
2-phenyl-6-methyl-6-p-(p-phenylaminophenyl) aminoanilinofluoran
2-benzyl-6-p-(p-phenylaminophenyl)aminoanilinofluoran
2-hydroxy-6-p-(p-phenylaminophenyl)aminoanilinofluoran
3-methyl-6-p-(p-dimethylaminophenyl)aminoanilinofluoran
3-diethylamino-6-p-(p-diethylaminophenyl) aminoanilinofluoran
3-diethylamino-6-p-(p-dibuthylaminophenyl) aminoanilinofluoran <Divinyl-Based Leuco Dyes>

3,3-bis[2-(p-dimethylaminophenyl)-2-(p-methoxyphenyl) ethenyl]-4,5,6,7-tetrabromophthalide
3,3-bis[2-(p-dimethylaminophenyl)-2-(p-methoxyphenyl) ethenyl]-4,5,6,7-tetrachlorophthalide
3,3-bis-[1,1-bis(4-pyrrolidinophenyl)ethylene-2-yl]-4,5,6,7-tetrachlorophthalide
3,3-bis-[1-(4-methoxyphenyl)-1-(4-pyrrolidinophenyl) ethylene-2-yl]-4,5,6,7-tetrachlorophthalide <Others>

1,1-bis-[2',2',2",2"-tetrakis-(p-dimethylaminophenyl) ethenyl]-2,2-dinitrileethane
1,1-bis-[2',2',2",2"-tetrakis-(p-dimethylaminophenyl) ethenyl]-2,b-naphthoylethane
1,1-bis-[2',2',2",2"-tetrakis-(p-dimethylaminophenyl) ethenyl]-2,2-diacetylethane
bis-[2',2',2",2"-tetrakis-(p-dimethylaminophenyl)ethenyl]-methylmalonatedimethyl Further in this invention, as a sensitizer, it is effective to add aliphatic amide such as amide stearate or amide palmitate, ethylene bisamide, montan wax, polyethylene wax, dibenzyl terephthalate, p-benzylbiphenyl, phenyl α-naphthylcarbonate, 1,4-diethoxynaphthalene, 1-hydroxy-2-phenylnaphthoate, 1,2-di-(3-methylphenoxy)ethane, oxalic acid di(p-methylbenzyl), β-benzyloxynaphthalene, 4-biphenyl-p-tolylether, o-xylylene-bis-(phenylether), 4-(m-methylphenoxymethyl)biphenyl or the like.

As the binder, the present invention, polyvinyl alcohol or denatured polyvinyl alcohol such as full saponificated polyvinyl alcohol of 200–1900 polimerization degree, partial saponificated polyvinyl alcohol, denatured polyvinyl alcohol by carboxy, denatured polyvinyl alcohol by amide, denatured polyvinyl alcohol by sulfonic acid, buthylal or the like, derivatives of cellulose such as hydroxyethyl cellulose, methyl cellulose, carboxymethyl cellulose, ethylcellulose or acetylcellulose, copolymer of styrene-maleic anhydride or styrene-buthadiene, polymer such as polyvinylchrolide, polyvinylacetate, polyacrylicamide, polyacrylicester, polibuthylal, polystyrene or copolymer of them and resin such as polyamide, silicon, petroleum, terpene, ketone and cumarone can be illustrated as examples. These high polymer are not only applied as solution dissolved in solvent such as water, alcohol, ketone, ester, or hydrocarbon but also as emulsion or paste dispersed in water or other solvents, and can be applied together up to the needs.

In this invention, the well-known stabilizer such as metallic (Ca, Zn) salt of p-nitrobenzoic acid or metallic (Ca, Zn) salt of monobenzyl phthalate may be added in moderate amounts without greatly hurting the effect of the present invention.

As the filler used in present invention can be preferred from inorganic or organic filler such as silica, calcium carbonate, kaoline, calcined kaoline, diatomaceous earth, talc, titanium oxide or aluminum hydroxide.

Moreover, release agents such as metallic salts of fatty acid, lubricants such as wax, ultra violet ray absorbers based on benzophenol or triazol, water proof agents such as grioxal, dispersing agents or deforming agents can be used.

In this invention, the amount of stabilizer, the amount of basic achromatic dye and the kind and amount of other component to be used is decided according to the required function and recording aptitude, and the desirable amount of each components is shown below wherein the amount of organic color developer is fixed to 1 parts.

Basic achromatic dye: 0.3–0.6 parts,
Stabilizer: 0.08–0.8 parts,
Filler: 1–3 parts.

The desirable amount of binder is 10–25 weight % to the total weight of solid.

The objected thermal sensitive recording sheet can be obtained by coating the color comprising above mentioned compositions on the surface of voluntary substrate such as paper, synthetic paper, plastic film or non-woven cloth.

Further, for the purpose to enhance the storage ability the over coating layer including a filler such as high polymer may be arranged over the thermal sensitive color developing layer. And also, for the purpose to enhance the storage ability and sensitivity, the under coating layer including an organic or an inorganic filler may be arranged under the thermal sensitive color developing layer.

Above mentioned organic color developer, basic achromatic dye and other additives which are added in accordance with the necessity are ground to fine particles of 1 μm or less diameter by means of pulverizer such as a ball mill, an attritor or a sand grinder, or adequate emulsification apparatus. By adding a binder and other necessary additives to said fine particles, the coating color can be fabricated.

The stabilizer of this invention has an color developing ability by itself. However, compared with that of the organic color developer specified in this invention, it is positioned to the lower level. With respect to the specified organic color developer, by using it 0.08–0.8 parts wherein the amount of color developer is fixed to 1 parts, it acts as a stabilizer as illustrated below.

First, the stabilizer of this invention has excellent efficiency for the display of dynamic color developing. The said excellent efficiency is caused by high melting, dissolving and dispersing rate and high solubility for saturation of the specified color developer and dye to the stabilizer of this invention. It can form instantly a recording image by instant contact with a heated thermal head.

And, the reason why the recording image is highly stabilized at heat-resistance, water proof and durability to oil is illustrated as follows. Generally, the thermal sensitive recording sheet is comprised of basic achromatic dye which is an electron donor and an organic acidity substance which is an electron acceptor such as a phenolic compound, an aromatic carboxyl acid, an organic sulfonic acid or the like. A heat fusion reaction between these basic achromatic dyes and color developers is a kind of acid-base reaction based on electron donation and acceptance, and by this reaction a semi stabilized "charge-transfer complex" is formed and color image can be developed. And the developed color image is highly stabilized even if it exposed for long time to the environment where is strongly affected by water, oil or temperature, because the stabilizer used in present invention is a derivative of specific aminobenzenesulfonamide which has urea and sulfonamide structure in the molecular.

If the amount of the stabilizer is smaller than 0.08 parts wherein the amount of an organic color developer is fixed to 1 parts the objected effects can not be obtained, and if it is bigger than 0.8 parts the color developer is diluted by the stabilizer and consequently causes the dropping problem of sensitivity.

EXAMPLES

The present invention is further illustrated by following examples. In the example and comparative examples the term of "parts" means "parts by weight".

Example 1

(Experiment No. 1–40)

| | |
|---|---|
| Solution A (dispersion of color developer) | |
| color developer (see table 1 and 3) | 6.0 parts |
| 10% polyvinyl alcohol water solution | 18.8 parts |
| water | 11.2 parts |
| Solution B (dispersion of dye) | |
| 3-(N-ethyl-N-isoamylamino)-6-methyl-7-anilinofluoran | 2.0 parts |
| 10% polyvinyl alcohol water solution | 4.6 parts |
| water | 2.6 parts |
| Solution C (dispersion of stabilizer) | |
| stabilizer (see table 1 and 3) | 4.0 parts |
| 10% polyvinyl alcohol water solution | 5.0 parts |
| water | 3.0 parts |

The solutions having above compositions are ground to average particle diameter of 1 μm with a sand grinder. Then, the resulting dispersions are mixed together in the proportion below so as to prepare the coating color.

| | |
|---|---|
| Solution A | 36.0 parts |
| Solution B | 9.2 parts |
| Solution C | 12.0 parts |
| kaoline clay (50% dispersion) | 12.0 parts |

The prepared coating color is applied to one side of 50 g/m$^2$ sheet substrate in a coating weight of 6.0 g/m$^2$ and dried up. Then, the sheet is processed by super calender to surface smoothness of 500–600 seconds. Thus, the thermal sensitive recording sheet is fabricated.

Comparative Example 1

(Experiment No. 41–45)

| | |
|---|---|
| Solution D (dispersion of color developer) | |
| color developer (see table 5) | 6.0 parts |
| 10% polyvinyl alcohol water solution | 18.8 parts |
| water | 11.2 parts |

| | |
|---|---|
| Solution B (dispersion of dye) | |
| 3-(N-ethyl-N-isoamylamino)-6-methyl-7-anilinofluoran | 2.0 parts |
| 10% polyvinyl alcohol water solution | 4.6 parts |
| water | 2.6 parts |

The solutions having above compositions are ground to average particle diameter of 1 μm with a sand grinder. Then, the resulting dispersions are mixed together in the proportion below so as to prepare the coating color. By using said coating color, the thermal sensitive recording sheet is fabricated by same procedure to the example 1.

| | |
|---|---|
| Solution D | 36.0 parts |
| Solution B | 9.2 parts |
| kaoline clay (50% dispersion) | 12.0 parts |

Comparative Example 2

(Experiment No. 46–50)

| Solution A (dispersion of color developer) | |
|---|---|
| color developer (see table 5) | 6.0 parts |
| 10% polyvinyl alcohol water solution | 18.8 parts |
| water | 11.2 parts |
| Solution B (dispersion of dye) | |
| 3-(N-ethyl-N-isoamylamino)-6-methyl-7-anilinofluoran | 2.0 parts |
| 10% polyvinyl alcohol water solution | 4.6 parts |
| water | 2.6 parts |

| Solution E (dispersion of stabilizer) | |
|---|---|
| stabilizer (see table 5) | 4.0 parts |
| 10% polyyinyl alcohol water solution | 5.0 parts |
| water | 3.0 parts |

The solutions having above compositions are ground to average particle diameter of 1 μm with a sand grinder. Then, the resulting dispersions are mixed together in the proportion below so as to prepare the coating color.

| | |
|---|---|
| Solution A | 36.0 parts |
| Solution B | 9.2 parts |
| Solution E | 12.0 parts |
| kaoline clay (50% dispersion) | 12.0 parts |

The prepared coating color is applied to one side of 50 $g/m^2$ sheet substrate in a coating weight of 6.0 $g/m^2$ and dried up. Then, the sheet is processed by super calender to surface smoothness of 500–600 seconds. Thus, the thermal sensitive recording sheet is fabricated.

The qualities and abilities of thermal sensitive recording sheets fabricated by above mentioned example and comparative examples are investigated, and the results are summed up in table 2, 4 and 6.

TABLE 1

| | Combination of organic color developer and stabilizer of example-1 | |
|---|---|---|
| No. | organic color developer | stabilizer |
| | EXAMPLE-1 | |
| 1 | 4-hydroxy-4'-isopropoxydiphenylsulfone | compound No. A 1 |
| 2 | 4-hydroxy-4'-isopropoxydiphenylsulfone | compound No. A 2 |
| 3 | 4-hydroxy-4'-isopropoxydiphenylsulfone | compound No. A 3 |
| 4 | 4-hydroxy-4'-isopropoxydiphenylsulfone | compound No. A 12 |
| 5 | 4-hydroxy-4'-isopropoxydiphenylsulfone | compound No. A 13 |
| 6 | 4-hydroxy-4'-isopropoxydiphenylsulfone | compound No. A 14 |
| 7 | 4-hydroxy-4'-isopropoxydiphenylsulfone | compound No. A 15 |
| 8 | 4-hydroxy-4'-isopropoxydiphenylsulfone | compound No. A 17 |
| 9 | 4-hydroxy-4'-n-butoxydiphenylsulfone | compound No. A 34 |
| 10 | 4-hydroxy-4'-n-butoxydiphenylsulfone | compound No. A 44 |
| 11 | 4-hydroxy-4'-n-butoxydiphenylsulfone | compound No. A 46 |
| 12 | 4-hydroxy-4'-n-butoxydiphenylsulfone | compound No. A 47 |
| 13 | 4-hydroxy-4'-n-butoxydiphenylsulfone | compound No. A 50 |
| 14 | 4-hydroxy-4'-n-butoxydiphenylsulfone | compound No. A 4 |
| 15 | 4-hydroxy-4'-n-butoxydiphenylsulfone | compound No. A 5 |
| 16 | 4-hydroxy-4'-n-butoxydiphenylsulfone | compound No. A 16 |
| 17 | 2,4'-dihydroxydiphenylsulfone | compound No. A 8 |
| 18 | 2,4'-dihydroxydiphenylsulfone | compound No. A 18 |
| 19 | 2,4'-dihydroxydiphenylsulfone | compound No. A 19 |
| 20 | 2,4'-dihydroxydiphenylsulfone | compound No. A 20 |

TABLE 2

| | | evaluation test results of example-1 | | | | | | | | | |
|---|---|---|---|---|---|---|---|---|---|---|---|
| | | (1) dynamic | heat resistance (2) | | | water proof (3) | | | durability to oil (4) | | |
| | No. | color density | before | after | remaining % | before | after | remaining % | before | after | remaining % |
| Example 1 | 1 | 1.00 | 1.00 | 0.95 | 95 | 1.00 | 0.90 | 90 | 1.00 | 0.92 | 92 |
| | 2 | 1.03 | 1.03 | 1.01 | 98 | 1.03 | 0.90 | 87 | 1.03 | 0.89 | 89 |
| | 3 | 1.04 | 1.04 | 1.00 | 96 | 1.04 | 0.89 | 86 | 1.04 | 0.88 | 85 |
| | 4 | 1.05 | 1.05 | 1.02 | 97 | 1.05 | 0.92 | 88 | 1.05 | 0.92 | 88 |
| | 5 | 1.03 | 1.03 | 1.01 | 98 | 1.03 | 0.93 | 90 | 1.03 | 0.93 | 90 |
| | 6 | 1.02 | 1.02 | 0.98 | 96 | 1.02 | 0.95 | 93 | 1.02 | 0.95 | 93 |
| | 7 | 1.01 | 1.01 | 0.96 | 95 | 1.01 | 0.97 | 96 | 1.01 | 0.92 | 91 |
| | 8 | 1.04 | 1.04 | 1.02 | 98 | 1.04 | 0.98 | 94 | 1.04 | 0.96 | 92 |
| | 9 | 1.05 | 1.05 | 1.03 | 98 | 1.05 | 0.98 | 93 | 1.05 | 0.96 | 91 |
| | 10 | 1.02 | 1.02 | 0.99 | 97 | 1.02 | 0.97 | 95 | 1.02 | 0.90 | 88 |
| | 11 | 1.00 | 1.00 | 0.98 | 98 | 1.00 | 0.96 | 96 | 1.00 | 0.98 | 98 |
| | 12 | 1.02 | 1.02 | 0.99 | 97 | 1.02 | 0.94 | 92 | 1.02 | 0.91 | 89 |
| | 13 | 1.03 | 1.03 | 1.02 | 99 | 1.03 | 0.93 | 90 | 1.03 | 0.96 | 93 |
| | 14 | 1.01 | 1.01 | 0.98 | 97 | 1.01 | 0.94 | 93 | 1.01 | 0.89 | 88 |
| | 15 | 1.00 | 1.00 | 0.98 | 98 | 1.00 | 0.92 | 92 | 1.00 | 0.92 | 92 |
| | 16 | 1.05 | 1.05 | 1.03 | 98 | 1.05 | 0.93 | 89 | 1.05 | 0.95 | 90 |
| | 17 | 1.04 | 1.04 | 1.02 | 98 | 1.04 | 0.95 | 91 | 1.04 | 0.89 | 86 |
| | 18 | 1.03 | 1.03 | 1.02 | 99 | 1.03 | 0.93 | 90 | 1.03 | 0.92 | 89 |
| | 19 | 1.02 | 1.02 | 0.98 | 96 | 1.02 | 0.90 | 88 | 1.02 | 0.93 | 91 |
| | 20 | 1.01 | 1.01 | 0.97 | 96 | 1.01 | 0.92 | 91 | 1.01 | 0.92 | 91 |

TABLE 3

| No. | Combination of organic color developer and stabilizer of example-1: organic color developer | stabilizer |
|---|---|---|
| | EXAMPLE-1 | |
| 21 | 2,4'-dihydroxydiphenylsulfone | compound No. A 21 |
| 22 | 2,4'-dihydroxydiphenylsulfone | compound No. A 22 |
| 23 | 2,4'-dihydroxydiphenylsulfone | compound No. A 23 |
| 24 | 2,4'-dihydroxydiphenylsulfone | compound No. A 24 |
| 25 | 4-hydroxy-4'-n-propoxydiphenylsulfone | compound No. A 25 |
| 26 | 4-hydroxy-4'-n-propoxydiphenylsulfone | compound No. A 26 |
| 27 | 4-hydroxy-4'-n-propoxydiphenylsulfone | compound No. A 27 |
| 28 | 4-hydroxy-4'-n-propoxydiphenylsulfone | compound No. A 28 |
| 29 | 4-hydroxy-4'-n-propoxydiphenylsulfone | compound No. A 29 |
| 30 | 4-hydroxy-4'-n-propoxydiphenylsulfone | compound No. A 30 |
| 31 | 4-hydroxy-4'-n-propoxydiphenylsulfone | compound No. A 31 |
| 32 | 4-hydroxy-4'-n-propoxydiphenylsulfone | compound No. A 32 |
| 33 | bis-(3-alyl-4-hydroxyphenyl)sulfone | compound No. A 33 |
| 34 | bis-(3-alyl-4-hydroxyphenyl)sulfone | compound No. A 9 |
| 35 | bis-(3-alyl-4-hydroxyphenyl)sulfone | compound No. A 35 |
| 36 | bis-(3-alyl-4-hydroxyphenyl)sulfone | compound No. A 36 |
| 37 | bis-(3-alyl-4-hydroxyphenyl)sulfone | compound No. A 37 |
| 38 | bis-(3-alyl-4-hydroxyphenyl)sulfone | compound No. A 38 |
| 39 | bis-(3-alyl-4-hydroxyphenyl)sulfone | compound No. A 39 |
| 40 | bis-(3-alyl-4-hydroxyphenyl)sulfone | compound No. A 40 |

TABLE 5-continued

| No. | Combination of organic color developer and stabilizer of comparative example-1 and 2: organic color developer | stabilizer |
|---|---|---|
| | sulfone | |
| 47 | 4-hydroxy-4'-n-butoxydiphenylsulfone | compound No. A 2 |
| 48 | 2,4'-dihydroxydiphenylsulfone | compound No. A 3 |
| 49 | 4-hydroxy-4'-n-propoxydiphenylsulfone | compound No. A 4 |
| 50 | bis-(3-alyl-4-hydroxyphenyl)sulfone | compound No. A 5 |

TABLE 4 evaluation test results of example-1

| | | (1) dynamic | heat resistance (2) | | | water proof (3) | | | durability to oil (4) | | |
|---|---|---|---|---|---|---|---|---|---|---|---|
| | No. | color density | before | after | remaining % | before | after | remaining % | before | after | remaining % |
| Example 1 | 21 | 1.01 | 1.01 | 0.97 | 96 | 1.01 | 0.93 | 92 | 1.01 | 0.88 | 87 |
| | 22 | 1.02 | 1.02 | 0.99 | 97 | 1.02 | 0.97 | 95 | 1.02 | 0.90 | 88 |
| | 23 | 1.05 | 1.05 | 1.03 | 98 | 1.05 | 0.98 | 93 | 1.05 | 0.96 | 91 |
| | 24 | 1.04 | 1.04 | 1.02 | 98 | 1.04 | 0.98 | 94 | 1.04 | 0.96 | 92 |
| | 25 | 1.03 | 1.03 | 1.02 | 99 | 1.03 | 0.93 | 90 | 1.03 | 0.96 | 93 |
| | 26 | 1.02 | 1.02 | 0.99 | 97 | 1.02 | 0.94 | 92 | 1.02 | 0.91 | 89 |
| | 27 | 1.00 | 1.00 | 0.98 | 98 | 1.00 | 0.91 | 91 | 1.00 | 0.90 | 90 |
| | 28 | 1.05 | 1.05 | 1.02 | 97 | 1.05 | 0.92 | 88 | 1.05 | 0.92 | 88 |
| | 29 | 1.04 | 1.04 | 1.00 | 96 | 1.04 | 0.89 | 86 | 1.04 | 0.88 | 85 |
| | 30 | 1.03 | 1.03 | 1.01 | 98 | 1.03 | 0.90 | 87 | 1.03 | 0.89 | 89 |
| | 31 | 1.01 | 1.01 | 0.96 | 95 | 1.01 | 0.97 | 96 | 1.01 | 0.92 | 91 |
| | 32 | 1.02 | 1.02 | 0.98 | 96 | 1.02 | 0.95 | 93 | 1.02 | 0.95 | 93 |
| | 33 | 1.03 | 1.03 | 1.01 | 98 | 1.03 | 0.93 | 90 | 1.03 | 0.93 | 90 |
| | 34 | 1.00 | 1.00 | 0.96 | 96 | 1.00 | 0.91 | 91 | 1.00 | 0.91 | 91 |
| | 35 | 1.05 | 1.05 | 1.03 | 98 | 1.05 | 1.00 | 95 | 1.05 | 1.00 | 95 |
| | 36 | 1.02 | 1.02 | 0.98 | 96 | 1.02 | 0.90 | 88 | 1.02 | 0.93 | 91 |
| | 37 | 1.03 | 1.03 | 1.02 | 99 | 1.03 | 0.93 | 90 | 1.03 | 0.92 | 89 |
| | 38 | 1.04 | 1.04 | 1.02 | 98 | 1.04 | 0.95 | 91 | 1.04 | 0.89 | 86 |
| | 39 | 1.05 | 1.05 | 1.03 | 98 | 1.05 | 0.93 | 89 | 1.05 | 0.95 | 90 |
| | 40 | 1.00 | 1.00 | 0.98 | 98 | 1.00 | 0.92 | 92 | 1.00 | 0.92 | 92 |

TABLE 5

| | No. | Combination of organic color developer and stabilizer of comparative example-1 and 2: organic color developer | stabilizer |
|---|---|---|---|
| 1 | 41 | 4-hydroxy-4'-isopropoxydiphenyl-sulfone | not added |
| | 42 | 4-hydroxy-4'-n-butoxydiphenylsulfone | not added |
| | 43 | 2,4'-dihydroxydiphenylsulfone | not added |
| | 44 | 4-hydroxy-4'-n-propoxydiphenylsulfone | not added |
| | 45 | bis-(3-alyl-4-hydroxyphenyl)sulfone | not added |
| 2 | 46 | 4-hydroxy-4'-isopropoxydiphenyl- | compound No. A 1 |

TABLE 6 evaluation test results of comparative example-1 and 2

| | No. | (1) dynamic color density | heat resistance (2) before | after | remaining % | water proof (3) before | after | remaining % | durability to oil (4) before | after | remaining % |
|---|---|---|---|---|---|---|---|---|---|---|---|
| 1 | 41 | 0.98 | 0.98 | 0.46 | 47 | 0.98 | 0.59 | 60 | 0.98 | 0.47 | 48 |
| | 42 | 0.97 | 0.97 | 0.47 | 48 | 0.97 | 0.59 | 61 | 0.97 | 0.51 | 53 |
| | 43 | 0.96 | 0.96 | 0.48 | 50 | 0.96 | 0.57 | 59 | 0.96 | 0.48 | 50 |
| | 44 | 0.98 | 0.98 | 0.47 | 48 | 0.98 | 0.61 | 62 | 0.98 | 0.49 | 50 |
| | 45 | 0.95 | 0.95 | 0.48 | 51 | 0.95 | 0.60 | 63 | 0.95 | 0.49 | 52 |
| 2 | 46 | 0.97 | 0.97 | 0.67 | 69 | 0.97 | 0.68 | 70 | 0.97 | 0.71 | 73 |
| | 47 | 0.96 | 0.96 | 0.67 | 70 | 0.96 | 0.72 | 75 | 0.96 | 0.72 | 75 |
| | 48 | 0.95 | 0.95 | 0.71 | 75 | 0.95 | 0.68 | 72 | 0.95 | 0.68 | 72 |
| | 49 | 0.97 | 0.97 | 0.70 | 72 | 0.97 | 0.76 | 78 | 0.97 | 0.67 | 69 |
| | 50 | 0.98 | 0.98 | 0.72 | 73 | 0.98 | 0.78 | 80 | 0.98 | 0.73 | 74 |

Remarks (1): Dynamic color density; Thermal sensitive facsimile KB-4800 (Toshiba Japan) is used for the evaluation. The density of images recorded with the condition of 18.03 volt of impressive energy and 3.2 milli second of pulse width are measured by Macbeth bensitometer (RD-914, Umber filter is used).

Remarks (2): Heat resistance; The specimen of thermal sensitive paper dynamically recorded by the method of remark (1) is placed for 24 hours in dry chamber set at 60° C., then the density of recorded portion is measured by Macbeth bensitometer. The remaining ratio is calculated by following formula.

$$\text{remaining ratio} = \frac{\text{image density after heat treatment}}{\text{initial image density}} \times 100(\%)$$

Remarks (3): Water proof; The specimen of thermal sensitive paper dynamically recorded by the method of remark (1) is dipped into 20° C. water for 24 hours, then the density of recorded portion is measured by Macbeth bensitometer. The remaining ratio is calculated by following formula.

$$\text{remaining ratio} = \frac{\text{image density after dipped into water}}{\text{initial image density}} \times 100(\%)$$

Remarks (4): durability to oil; To the specimen of thermal sensitive paper dynamically recorded by the method of remark (1) small amount of salad oil is applied, then after 10 seconds the salad oil is wiped off by filtering paper. The specimen is kept in the atmosphere of room temperature for 1 hour, and the density of image is measured by Macbeth bensitometer. The remaining ratio is calculated by following formula.

$$\text{remaining ratio} = \frac{\text{image density after contact with oil}}{\text{initial image density}} \times 100(\%)$$

Remarks (5): Compound number and chemical formula of the stabilizers mentioned in comparative example 2 are shown below.

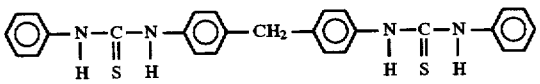

(1)

-continued

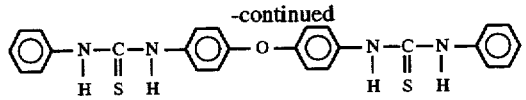

(2)

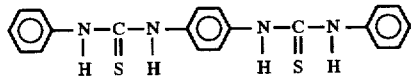

(3)

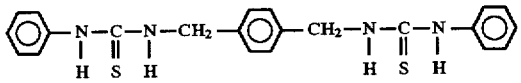

(4)

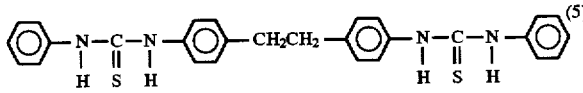

(5)

The thermal sensitive recording sheet of this invention has following excellent features.

(1) High sensitivity: Having quick response time, sharp and high density image can be obtained at high speed and high density recording condition.

(2) Durability to oil: The images do not erase by the contact with plasticizer, salad oil or vinegar.

(3) Water proof: The image do not erase by the contact with water.

(4) Heat resistance: The image are stabilized even if it is kept in the high temperature condition.

What is claim is:

1. A thermal sensitive recording sheet comprising a thermally sensitive color developing layer mainly composed of a colorless or pale colored basic achromatic dye and an organic color developer arranged on a substrate, wherein said thermally sensitive developing layer includes, as said organic color developer, at least one compound selected from the group consisting of formula (I)

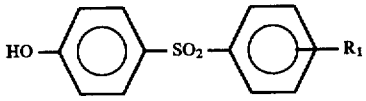

(I)

wherein $R_1$ represents a hydroxy group, an n-propoxy group, an isopropoxy group or an n-butoxy group, and formula (II)

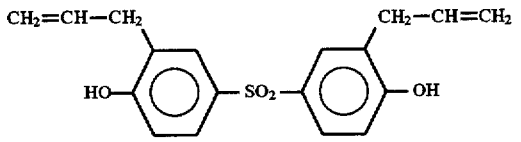

(II)

and further includes, as a stabilizer, in an amount of 0.08–0.8 parts by weight per part by weight of said organic color developer, a compound of formula (III)

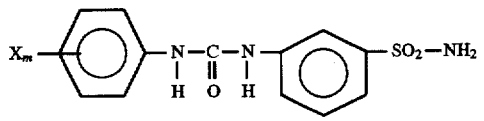

(III)

wherein X represents a lower alkyl group of 1–4 carbon atoms, an alkoxy group of 1–3 carbon atoms, a hydrogen atom, a nitro group, a cyano group or a halogen atom, and m is an integral number of 1 to 3.

2. A method of stabilizing a recorded image, against heat, water and/or oil, on a thermally sensitive recording sheet comprising a thermally sensitive color developing layer mainly composed of a colorless or pale colored basic achromatic dye and an organic color developer arranged on a substrate, wherein said thermally sensitive developing layer includes, as said organic color developer, at least one compound selected from the group consisting of formula (I)

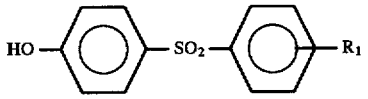

(I)

wherein $R_1$ represents a hydroxy group, an n-propoxy group, an isopropoxy group or an n-butyl group, and formula (II)

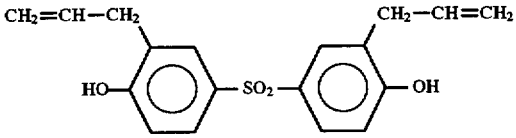

(II)

said method comprising:

admixing a stabilizer compound of formula (III)

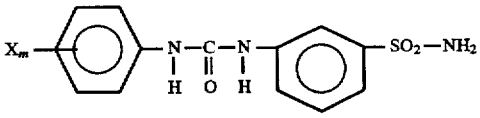

(III)

wherein X represents a lower alkyl group of 1–4 carbon atoms, an alkoxy group of 1–3 carbon atoms, a hydrogen atom, a nitro group, a cyano group or a halogen atom, and m is an integral number of 1 to 3, with said organic color developer in an amount of 0.08–0.8 parts by weight per part by weight of said organic color developer.

* * * * *